United States Patent [19]

Haga et al.

[11] Patent Number: 4,897,529

[45] Date of Patent: Jan. 30, 1990

[54] BREWING TANK AND BREWING REGENERATIVE HEATER

[75] Inventors: Ko Haga, 105 Teppocho, Senda-shi, Miyagi-ken; Masanari Ioroi, Tokyo, both of Japan

[73] Assignees: Furukawa Electric Co., Ltd., Tokyo; Ko Haga, Sendai, both of Japan

[21] Appl. No.: 153,908

[22] Filed: Feb. 9, 1988

[51] Int. Cl.[4] ..... H05B 3/40

[52] U.S. Cl. ..... 219/534; 219/523

[58] Field of Search ..... 219/523, 534, 335, 336, 219/316, 318, 312, 544, 437

[56] References Cited

U.S. PATENT DOCUMENTS 3,564,589 2/1971 Arak ..... 219/523 X

*Primary Examiner*—Clifford C. Shaw
*Assistant Examiner*—M. Lateef
*Attorney, Agent, or Firm*—Foley & Lardner, Schwartz, Jeffery, Schwaab, Mack, Blumenthal & Evans

[57] ABSTRACT

A brewing tank which has a regenerative heater inserted into the tank out of the tank through the wall of the tank having heat insulation, and a brewing regenerative heater which has a regenerator having a regenerative bobbin, a heater wound on the outer periphery of the regenerative bobbin and a regenerative conduit coated on the outer periphery of the regenerative bobbin wherein the regenerator is provided in an outer cylinder. Thus, the brewing tank and the brewing regenerative heater can suitably and efficiently manage the temperature of unrefined soy in a tank.

4 Claims, 3 Drawing Sheets

BREWING TANK AND BREWING REGENERATIVE HEATER

BACKGROUND OF THE INVENTION

This invention relates to a brewing (fermenting) tank of the closed type adapted to accelerate the brewing of materials to be brewed, such as soy, miso and a regenerative heater adapted for the brewing tank.

The breeding and metabolism of microorganism mainly produce in the brewing a product, such as soy or miso.

When the soy or miso is produced by means called "natural preparing or", a wooden fermenting or a concrete fermenting tank installed in a housing is utilized as a preparing vessel.

When the soy or miso is brewed in such a preparing vessel in a natural weather environment, it generally takes one year or longer to mature it.

However, the brewing of the soy or miso can be shortened in the maturing period while holding high quality by developing a low temperature preparing method, such as a technique for managing the temperature of the unrefined soy as a temperature brewing method, i.e., an unrefined soy temperature managing method for holding unrefined soy at suitable temperature for a predetermined period by preparing the unrefined soy at low temperature.

Ordinarily, an air conditioner is provided in a housing in which a preparing vessel is installed as temperature managing means in the unrefined soy temperature managing method as means for heating the whole housing. Since this means must manage the temperature in the whole housing, it has high facility cost and operation expenses.

To cope with this, it is proposed to build a tank of large capacity out of the housing by means of building material having excellent heat insulating property such as FRP, resin lining steel plates.

In brewing soy or miso using a large-sized brewing tank out of the housing as described above when applying the conventional unrefined soy temperature managing method, suitable heating means, such as a hot water circulating jacket or an electric heater is provided out of the brewing tank, and the heating means is covered with various heat insulating materials. Thus, the unrefined soy is heated with the heated means in the tank through the heating means in the brewing tank.

A waterproof heater is contained in the brewing tank as other heating means to directly heat the unrefined soy in the brewing tank through the heater.

In case of the brewing tank having the heating means at the periphery of the tank in the above-mentioned prior art, the outer wall of the tank is heated through the heating means, and the unrefined soy is heated in the tank by the thermal conduction of the heat from the outer wall. Heat does not readily arrive at the center of the tank by the heating means out of the tank, and the quantity of the heat dissipated from the heating means directly to the atmospheric air is not little. Thus, it is difficult to uniformly heat the unrefined soy in the tank and to suppress the loss of the thermal heat.

The above-mentioned drawbacks take place, particularly, when the brewing tank of outdoor installation type is increased in size due to the economy and mass productivity.

In the above-described prior art, in case of the heating means for containing the heater in the brewing tank, the unrefined soy in the tank can be directly heated by the heater, thereby eliminating mostly the thermal energy loss. But, the periphery of the heater becomes overheated and of ununiform temperature such that the temperature at the remote portion from the heater becomes insufficient and there is possibility that the useful microorganism of brewing dies by the overheat at the periphery of the heater.

SUMMARY OF THE INVENTION

Accordingly, an object of this invention is to provide a brewing tank and a brewing regenerative heater which can eliminate the above-mentioned drawbacks and can suitably and efficiently manage the temperature of the unrefined soy in a tank.

In order to achieve the above and other objects, there is provided according to the invention a brewing tank comprising a regenerative heater inserted into the tank from out of the tank through the wall of the tank which is heat insulated.

In order also to achieve the above and other objects there is also provided according to the invention a brewing regenerative heater comprising a regenerator having a regenerative bobbin, a heater wound on the outer periphery of the regenerative bobbin and a regenerative conduit coated on the outer periphery of the regenerative bobbin wherein the regenerator is provided in an outer cylinder.

In case of the brewing tank according to the invention, the unrefined soy in the tank can be heated directly by the regenerative heater inserted into the tank having heat insulation. Thus, the loss of thermal energy, i.e., the heat dissipation to the exterior can be suppressed to accelerate the brewing of the unrefined soy efficiently. Further, since it is heated by the regenerative heater, an overheat does not occur at the periphery of the heater to eliminate the extinction of the useful microorganism for the brewing.

In case of the brewing regenerative heater according to the invention, the regenerator having the regenerative bobbin, the heater and the regenerative pipe is mounted in the outer cylinder. Thus, when this regenerative heater is inserted into the tank and the heater is heated, the thermal energy from the heater is temporarily stored in the regenerative bobbin and the regenerative pipe having large thermal capacity, and the thermal energy dissipated from the regenerative bobbin and the regenerative pipe is transmitted through the outer cylinder to the unrefined soy in the tank.

Therefore, the overheated state of the periphery of the heater observed when the thermal energy is dissipated from the heater directly into the tank does not occur, and the thermal energy from the regenerative heater is immersed, after the lapse of a predetermined time, to the sections in the tank to heat the unrefined soy.

Then, the heater is turned ON and OFF at good timing to control the temperature of the unrefined soy in the tank. In this case, since the regenerative bobbin and the regenerative pipe have large thermal capacity, abrupt temperature rise or fall do not occur, and the unrefined soy in the tank is held at predetermined temperature to suitably manage the temperature of the unrefined soy.

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

An embodiment of a brewing tank according to the present invention will be first described in detail with reference to FIGS. 1 to 3.

Figure 1:
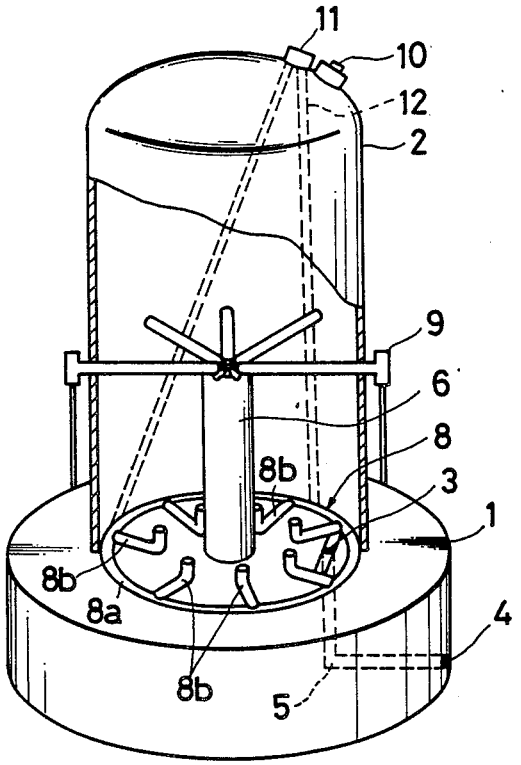
FIG. 1 is a perspective view of partly opened state schematically showing an embodiment of a brewing tank according to the present invention.

In FIG. 1, the tank comprises a concrete foundation 1, and a vertical cylindrical tank 2, which as can be seen is of the closed type, having a heat insulation, installed on the foundation 1.

Figure 2:
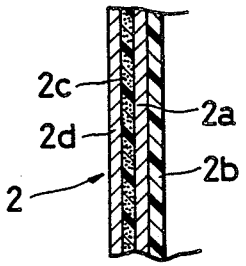
FIG. 2 is a sectional view showing the layer structure of the wall of the tank.
Figure 3:
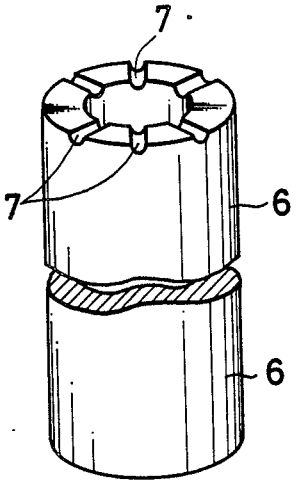
FIG. 3 is a perspective view partly omitted of a trestle installed in the tank.

This tank 2 has, as shown in FIG. 2, a main member 2*a* made, for example, of a steel plate, a lining member 2*b* made, for example, of an epoxy resin for lining the inner surface of the main member 2*a*, a polyurethane heat-insulating member 2*c* sprayed to the outer peripheral surface of the main member 2*a*, and a sheath member 2*d* made, for example, of a coated iron plate for the outer periphery of the heat-insulating member 2*c*.

In FIG. 1, the upper surface of the foundation 1 for closing the bottom of the tank 2, i.e., the bottom of the tank is formed in a tapered or conical shape so as to allow the content (to be brewed) in the tank to readily flow in a predetermined direction in such a manner that the outlet opening 3 formed at the lowest position of the bottom surface is connected by a conduit 5 to an unrefined soy outlet 4 formed on the outer surface of the foundation 1.

In FIG. 1, a trestle 6 for supporting a heater is positioned at the center on the bottom in the tank 2. A plurality of grooves 7 for supporting the ends of regenerative heaters 9 are radially formed as will be described later as shown in FIG. 3 on the upper surface of the trestle 6.

In FIG. 1, an agitator 8 for agitating the unrefined soy is composed of a ring-shaped conduit 8*a*, and branch conduits 8*b* radially connected to the inner surface of the ring-shaped conduit 8*a*. The agitator 8 is laid on the outer periphery of the trestle 6 on the bottom in the tank 2.

In FIG. 1, a plurality of regenerative heaters 9 are horizontally concentrically passed from the exterior to the interior through the body wall of the tank 2, and the ends of the regenerative heaters 9 are engaged with the grooves 7 on the trestle 6 to be supported.

In addition, as shown in FIG. 1, a manhole (not illustrated) and a header 10 for supplying compressed air are provided adjacent to the manhole (not illustrated) on the upper surface of the tank 2.

A compressor, not shown, is connected to the header 10 for supplying the compressed air, and a valve and a pressure gauge for diffusing the air are provided, though not shown, and the header 10 is connected through an air supply conduit 11 to the agitator 8.

When maturing unrefined soy in the brewing tank exemplified in FIG. 1, a mixture of saline water cooled to 5° C. or lower and wheat is prepared in the tank 2, unrefined soy at 15° C. or lower immediately after the preparation is held in the tank 2, then held at this low temperature for approx. 15 to 30 days, and then gradually heated to a target of approx. 25° C. by the regenerative heaters 9 to accelerate the breeding and the fermenting of lactic acid bacterias.

Air is diffused by the the agitator 8 in the bottom of the tank during the fermenting period to agitate the unrefined soy to equalize the temperature of the unrefined soy.

When the fermentation of the unrefined soy is advanced to certain degree, the fermentation heat is generated. Thereafter, the heating of the regenerative heaters 9 may be stopped.

When the unrefined soy is matured as described above, thermal energy (the value converted to power consumption) is reduced to approx. 1/5 as compared with the conventional heating system.

The materials of the tank 2 described above preferably employs FRP or resin lining steel plate in view of corrosion resistance and mechanical strength for the fermented soy process.

The shape of the tank 2 is not limited to the cylindrical or square-sectional column, but may sufficiently be of a hollow vessel.

The positions of the regenerative heaters 9 in the tank 2 are set at predetermined positions in response to the size of the whole tank and the strength of the wall of the tank.

Figure 4:
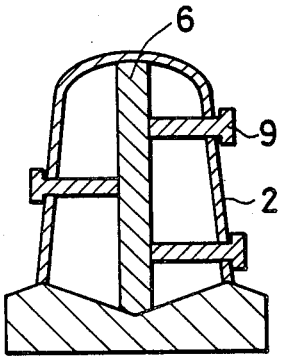
FIGS. 4 to 6 are sectional views schematically showing other embodiments of a brewing tank according to the invention.

For example, as shown in FIG. 4, the trestle 6 is provided elevationally in the tank 2, and a plurality of regenerative heaters 9 are installed in different heights in the tank 2 through the trestle 6.

Figure 5:
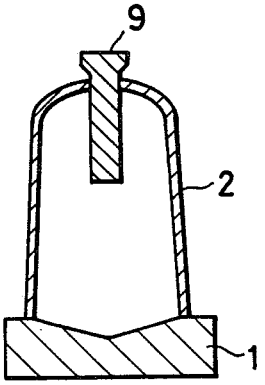
Figure 6:
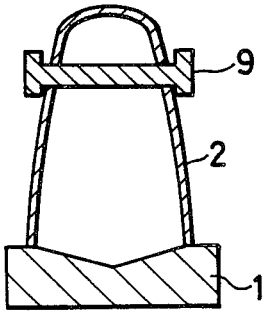

As other example as shown in FIG. 5, regenerative heaters 9 are inserted from upper outside of the tank 2 to lower inside of the tank 2 so that the regenerativek heaters 9 are supsended through the upper wall of the tank.

Further, when the tank 2 is small, regenerative heaters 9 are so provided as to pass the body of the tank as shown in FIG. 5.

The regenerative heaters 9 mounted in the brewing tank of the invention have high regenerative performance to eliminate local high temperature in the object to be heated due to microorganism but to hold approx. 20° to 30° C. necessary to accelerate the fermentation of the unrefined soy.

The regenerative heaters 9 have heating wires, such as nichrome wire for heating ceramic material having high regeneration to dissipate the heat regenerated in the ceramic material from the outer surface of the heater into the unrefined soy to thermally exchange the heat with the unrefined soy.

The temperature of the regenerative heaters 9 lowered due to the above-mentioned thermal exchange are again regenerated by the operation of a thermostat in the heater. This operation is automatically repeated to hold the temperature of the object of the unrefined soy for the period to be fermented.

Then, an embodiment of the regenerative heater 9 according to the invention will be described with reference to FIG. 7.

Figure 7:
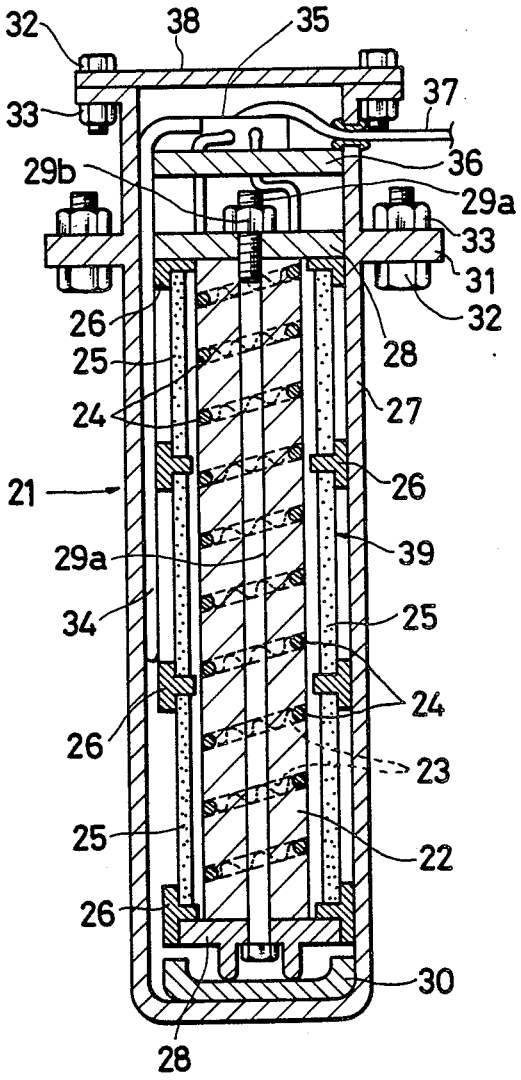
FIG. 7 is a sectional view showing an embodiment of a brewing regenerative heater according to the invention.

The regenerative heater 9 exemplified in FIG. 7 has an outer cylinder 27 and a regenerator 39.

The main member for forming the regenerator 39 includes a regenerative bobbin 22, a heater 24, and a regenerative conduit 25, and the sub member for forming the regenerator 39 includes a spacer 26, a partition plate 28, a stay bolt 29*a*, and a nut 29*b*.

The regenerative bobbin 22 is formed of zircon corodierite mainly made of high regenerative silica, alumina, zirconia, magnesia with spiral groove 23 formed on the surface thereof.

The heater 24 is formed of nichrome wire, and the heater 24 is engaged within the groove 23 of the regenerative bobbin 22 to be wound on the outer periphery of the regenerative bobbin 22.

The regenerative conduit 25 is formed of a mullite mainly containing silica and alumina. The inner diameter of the regenerative conduit 25 is larger than that of the regenerative bobbin 22 wound with the heater 24 and smaller in the longitudinal size of the regenerative conduit 25 than the regenerative bobbin 22.

The spacer 26 is made of fluorine resin (trade name, Teflon), and the partition plate 28 is made of ceramic material.

The outer cylinder 27 is formed of plastic, FRP or stainless steel having high thermal conducitivity, high thermal permeability and high thermal resistance, and, in order to further improve the corrosion resistance, is coated, for example, with flourine resin.

The outer cylinder 27 thus formed has a flange 31 at the outer periphery near the open end (upper end) thereof, and a bolt 32 and a nut 33 at the flange 31.

Further, the outer cylinder 27 also has a heat resistant stopper 30 in the bottom therein, and a cover 28 attached through the bolt 32 and the nut 33 in the open end of the outer cylinder 27.

In the construction described above, a plurality of regenerative conduits 25 are applied adjacently to the upper and lower portions on the outer periphery of the regenerative bobbin 22 wound with the heater 24. Spacers 26 are contacted between the adjacent portions of the regenerative conduits 25 and at upper and lower ends; the partition plates 28 are superposed on the outer surfaces of the spacers 25 disposed at both uper and lower ends. These components of the are integrally coupled with the stay bolts 29*a* passing through the upper and lower partition plates 28 and together with the heater 24 and a nut 29*b* clamped at the bolt 29*a* construct the regenerator 39.

The regenerator 39 constructed in this manner is inserted together with a temperature measuring unit 34 disposed outside the regenerator 39 into the outer cylinder 27, and held at a predetermined position by the stopper 30 in the outer cylinder 27.

In this case, the spacers 26 prevent the regenerative bobbin 22 from contacting the regenerative conduits 25 and the regeneraive conduits 25 from the outer cylinder 27.

A terminal box 35 is attached through a plate 36 in the upper interior of the outer cylinder 27 in which the regenerator 39 and the temperature measuring unit 34 are provided. The terminals of the heater 24 and the temperature measuring unit 34 are connected to the wiring connectors in the terminal box 35, and the cable 37 of the terminal box 35 is led externally through the outer cylinder 27 in a hermetically sealed manner.

Thus, the outer cylinder 27 in which the predetermined components are prepared is contacted with a cover 38 at its open end, and the cover 38 is clamped through a bolt 32 and a nut 33 with the outer cylinder 27.

The regenerative heaters 9 described with reference to FIG. 7 are inserted into the tank 2 as shown in FIGS. 1, 4 to 6, and attached through the flange 31 of the outer cylinder 27, bolts 32 and nuts 33 into the tank 2, and the heaters 24 are connected to a power source circuit (not shown), and the temperature measuring unit 34 is connected to a temperature controller (not shown). Further, the temperature controller connected to the temperature measuring unit 34 is contacted also with temperature sensors (not shown) attached in place in the tank 2, and the temperature controller adjusts the temperature of the unrefined soy according to the information from the temperature measuring units 34 and the temperature sensors.

In the regenerative heater 9 of the invention, the heater 24 wound on the outer periphery of the regenerative bobbin 22 may be of the kind ordinarily used, like nichrome wire or panel heater.

The regenerative material used for the regenerative bobbin 22 and the regenerative conduit 25 in which the regeneration is generally proportional to the mass, may preferably have larger mass, such as sintered material containing mainly silica or alumina.

The material of the outer cylinder 27 necessary to have corrosion resistance is preferably plastic, FRP having heat resistance, and when the outer cylinder 27 should have strength, the material is preferably metal, such as stainless steel.

When the heat radiated from the regenerative heater 9 is far infrared ray, if the outer cylinder 27 is formed of plastic, such as FRP, the transmission of the far infrared ray is preferable.

When the terminal box 35 in the outer cylinder 27 is omitted, a junction box is attached at the portion immediately after the heater as a structure continuing the regenerative heater 9.

According to the present invention as described above, the brewing tank directly heats the unrefined soy in the tank through the regenerative heaters inserted into the tank having heat insulation to efficiently suppress the loss of the thermal energy and to suitably accelerate the fermention of the unrefined soy. Therefore, the tank can brew the unrefined soy in mass production inexpensively in a short period in high quality as brewing tank of outdoor installation type.

Further, according to the invention as described above, the brewing regenerative heater provides therein the regenerator having the regenerative bobbin, heater and regenerative conduits in the outer cylinder. Therefore, when used for heating the unrefined soy by inserting the regenerative heaters into the tank, the heat dissipating state from the regenerator having large thermal capacity is stabilized to be preferably as the unrefined soy heater in the brewing tank to accelerate the fermentation of the unrefined soy.

What is claimed is:

1. A brewing tank of the closed type comprising a housing wall, said wall being insulated, a regenerative heater inserted into the tank from outside of the tank through the wall of the tank, said regenerative heater comprising a regenerator having a regenerative bobbin, a heater wound on the outer periphery of the regenerative bobbin and a regenerative conduit on the other periphery of the regenerative bobbin.

2. The brewing regenerative heater according to claim 1, wherein said outer wall is made of a stainless steel.

3. The brewing regenerative heater according to claim 1, wherein said outer wall is made of an FRP.

4. A brewing tank of the closed type comprising a housing wall, a plurality of regenerative heaters disposed within said tank extending radially outwardly from a central location therein through said wall, a trestle disposed within said tank and one end of each of said heaters being supported on said trestle.

* * * * *